US005854646A

United States Patent [19]

Barinaga et al.

[11] Patent Number: 5,854,646

[45] Date of Patent: Dec. 29, 1998

[54] DIAPHRAGM PUMP FOR INK SUPPLY

[75] Inventors: John A. Barinaga, Portland; Eric L. Gasvoda, Salem, both of Oreg.

[73] Assignee: Hewlett-Packard Company, Palo Alto, Calif.

[21] Appl. No.: 846,785

[22] Filed: Apr. 30, 1997

Related U.S. Application Data

[63] Continuation-in-part of Ser. No. 429,915, Apr. 27, 1995, and a continuation-in-part of Ser. No. 566,833, Dec. 4, 1995.

[51] Int. Cl.[6] ..... B41J 2/175

[52] U.S. Cl. ..... 347/85

[58] Field of Search ..... 347/85, 86, 87

[56] References Cited

U.S. PATENT DOCUMENTS

| | | | |
|---|---|---|---|
| 5,252,993 | 10/1993 | Tomii et al. | 346/140 R |
| 5,259,737 | 11/1993 | Kamisuki et al. | 417/322 |
| 5,409,134 | 4/1995 | Cowger et al. | 222/1 |
| 5,450,112 | 9/1995 | Scheffelin | 347/87 |
| 5,489,932 | 2/1996 | Ceschin et al. | 347/87 |
| 5,537,134 | 7/1996 | Baldwin et al. | 347/85 |
| 5,721,576 | 2/1998 | Barinaga | 347/85 |

*Primary Examiner*—Shawn Riley
*Attorney, Agent, or Firm*—Kevin B. Sullivan

[57] ABSTRACT

An ink supply having a diaphragm pump for providing ink to a printhead. The diaphragm pump includes a barrier layer and a chassis defining a variable volume chamber. The chassis has a flange disposed proximate an opening in the chassis. Also included in the diaphragm pump is a crimp cap. The crimp cap is disposed on the chassis with the barrier layer disposed between the crimp cap and the chassis. The crimp cap engages the flange to compress the barrier layer against the chassis to define, at least partially, the variable volume chamber. The barrier layer limits the diffusion of air through the diaphragm into the chamber. An elastomer layer is disposed between the chassis and the vapor barrier layer, limiting passage of liquid within the chamber through the diaphragm.

12 Claims, 6 Drawing Sheets

SECTION B-B′

DIAPHRAGM PUMP FOR INK SUPPLY

CROSS REFERENCE TO RELATED APPLICATIONS

This application is a continuation in part of Patent Application entitled "Ink Supply for an Ink-jet Printer" filed on Apr. 27, 1995 as Ser. No. 08/429,915 and Patent Application entitled "An Ink Supply Having An Integral Pump" filed on Dec. 4, 1995 as Ser. No. 08/566,833 both of which are assigned to the assignee of the present invention and incorporated herein by reference.

BACKGROUND OF THE INVENTION

The present invention relates to an ink supply for an ink-jet printer having a diaphragm pump providing ink from the ink supply to a printhead. More particularly, the present invention relates to a method and apparatus for forming a highly reliable diaphragm pump capable of running repeated cycles without failure.

The use of an ink supply that is separately replaceable from the printhead is disclosed in patent application Ser. No. 08/429,915. The advantage of this type of ink supply is that it allows the user to replace the ink container without replacing the printhead. The printhead can then be replaced at or near the end of printhead life and not when the ink container is exhausted.

Ser. No. 08/429,915 discloses the use of a diaphragm pump that is integral to an ink container. The diaphragm pump is actuated by an actuator associated with the ink-jet printer for supplying ink from the ink container to the printhead. The use of a pump associated with the ink container ensures a reliable supply of ink to the ink-jet printhead. An interruption in ink flow to the printhead can result in a reduction in print quality or damage to the printhead. This interruption in the flow of ink to the printhead during operation of the printhead can result printhead deprime which can result in excessive heating of the printhead. If this printhead heating is severe enough the printhead reliability can be reduced or the printhead can fail. Therefore, it is important that the apparatus used to provide ink from the ink container to the printhead be highly reliable.

The diaphragm pump as disclosed in Ser. No. 08/429,915 includes a chassis and a diaphragm attached to the chassis. Engagement of the diaphragm by an actuator varies the volume of the chamber defined by the chassis and diaphragm. Varying the volume of the chamber allows ink to be drawn into the chamber and expelled from the chamber. Ink is drawn into the chamber from an ink reservoir. Ink expelled from the chamber is transferred to the printhead by way of an ink conduit.

It is important that the diaphragm pump be highly reliable. The diaphragm pump should be capable of operating over a large number of actuation cycles without producing fatigue failures in the diaphragm which may result in ink leakage. In addition, the diaphragm should be strong and resistant to rupturing if the ink container is dropped.

The diaphragm on the diaphragm pump should be flexible so that the force required to activate the pump is relatively low. The use of a lower activation force diaphragm pump allows the use of actuators that have lower output force capability. These lower output force actuators tend to be lower cost than actuators having higher output force requirements, reducing to the cost of the printing system In addition, the use of lower force actuators tends to reduce the cost of a retention system used to secure the ink container to the printer. The use of lower cost retention systems tends to reduce the cost of the printing system.

The diaphragm should also be a good barrier for both liquid and gas. It is important that the diaphragm prevent water within the ink from evaporating through the diaphragm altering the viscosity of the ink. In addition, it is important that air be prevented from permeating through the diaphragm producing air bubbles inside the chamber. These air bubbles tend to reduce the pump efficiency as well as introduce air bubbles to the printhead. Air bubbles once in the printhead may enter an ink ejection chamber reducing the volume of ink in the ejection chamber. If sufficient displacement of ink occurs print quality can be reduced as well as a reduction in printhead cooling can occur. This reduction in cooling can result in overheating of the resistive heating element which if severe enough can result in a catastrophic failure of the heating element.

Finally, the diaphragm pump should provide a consistent discharge volume. This discharge volume should have little variation from ink container to ink container. In addition, the diaphragm pump should be well suited for high volume manufacturing techniques allowing the ink container to be produced at lower cost.

SUMMARY OF THE INVENTION

The present invention is an ink supply of the type having a diaphragm pump for providing ink to a printhead. The diaphragm pump includes a barrier layer and a chassis defining a variable volume chamber. The chassis has a flange disposed proximate an opening in the chassis. Also included in the diaphragm pump is a mechanical fastening device. The mechanical fastening device is disposed on the chassis with the barrier layer disposed between the fastening device and the chassis. The fastening device engages the flange to compress the barrier layer against the chassis to define, at least partially, the variable volume chamber.

Another aspect of the present invention is a diaphragm pump having a chassis and a diaphragm. The diaphragm includes a vapor barrier layer for limiting the diffusion of air through the diaphragm into the chamber. Also included in the diaphragm is an elastomer layer disposed between the chassis and the vapor barrier layer. The elastomer layer limiting passage of liquid within the chamber through the diaphragm.

DETAILED DESCRIPTION OF THE PREFERRED EMBODIMENT

Figure 1:
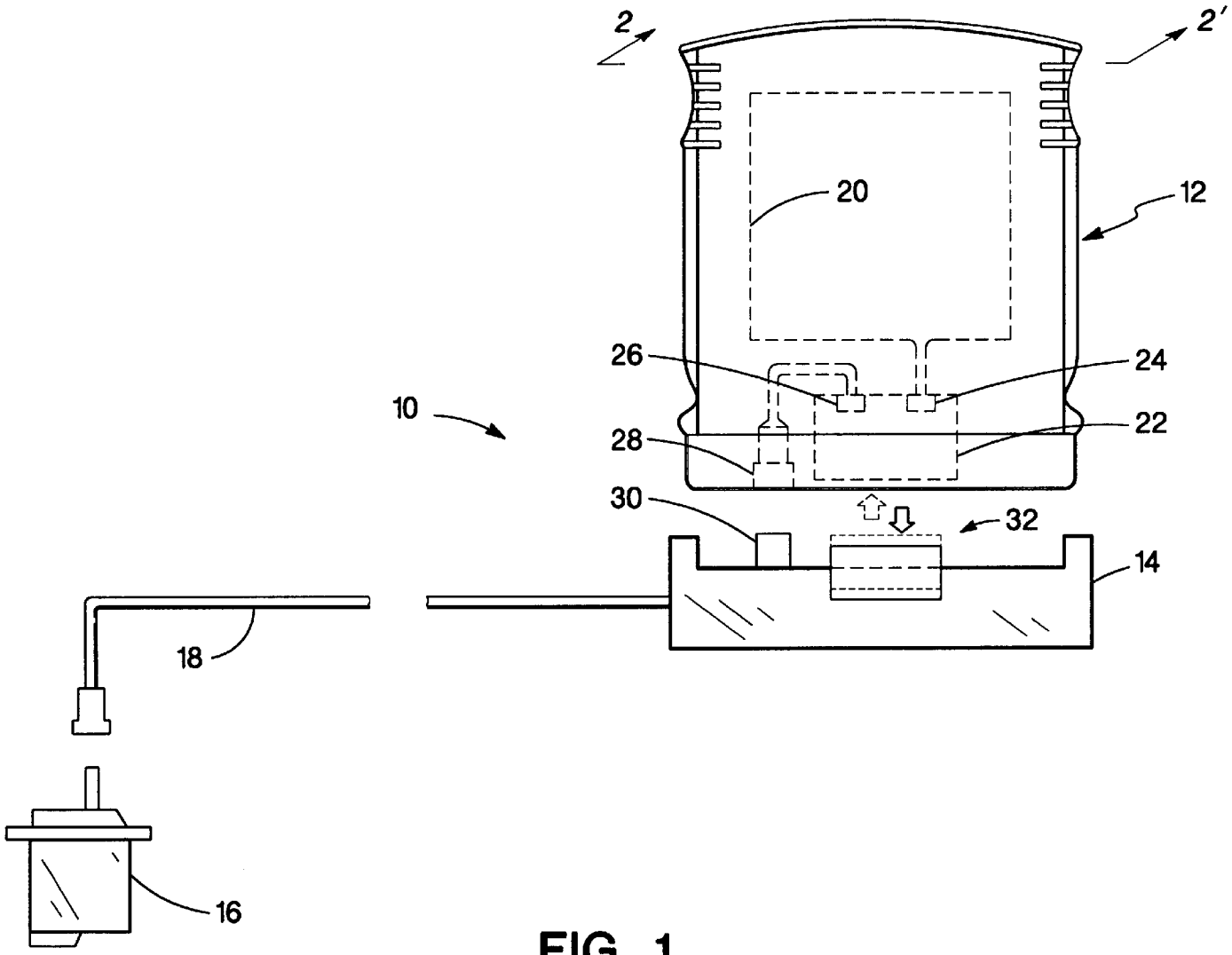
FIG. 1 depicts a schematic representation of an ink container having a diaphragm pump of the present invention for providing ink to an ink-jet printhead.

FIG. 1 depicts an ink-jet printing system 10 which includes an ink container 12 that contains a diaphragm pump of the present invention. The printing system 10 also includes a supply station 14 for receiving the ink container 12. The supply station 14 is fluidly connected to a printhead 16 by a conduit 18.

The ink container 12 includes an ink reservoir 20, a diaphragm pump portion 22 and an inlet 24 for selectively allowing fluid to pass from the ink reservoir 20 to the diaphragm pump portion 22. Also included in the ink container 12 is an ink outlet 26 for selectively allowing fluid to pass from the diaphragm pump portion 22 to a fluid outlet 28.

The supply station 14 includes a fluid inlet 30 and an actuator 32. With the ink container 12 properly positioned in the supply station 14 the fluid outlet 28 associated with the ink container fluidicly connects with the fluid inlet 30 associated with the supply station 14. In addition, proper positioning of the ink container 12 in the supply station 14 allows the actuator 32 to engage the diaphragm pump portion 22. This engagement between the actuator 32 and the diaphragm pump portion 22 produces the passage of fluid from the ink reservoir 20 to the printhead 16. The diaphragm pump portion 22 and actuator 32 ensure a constant supply of ink is provided to the printhead 16.

Figure 2:
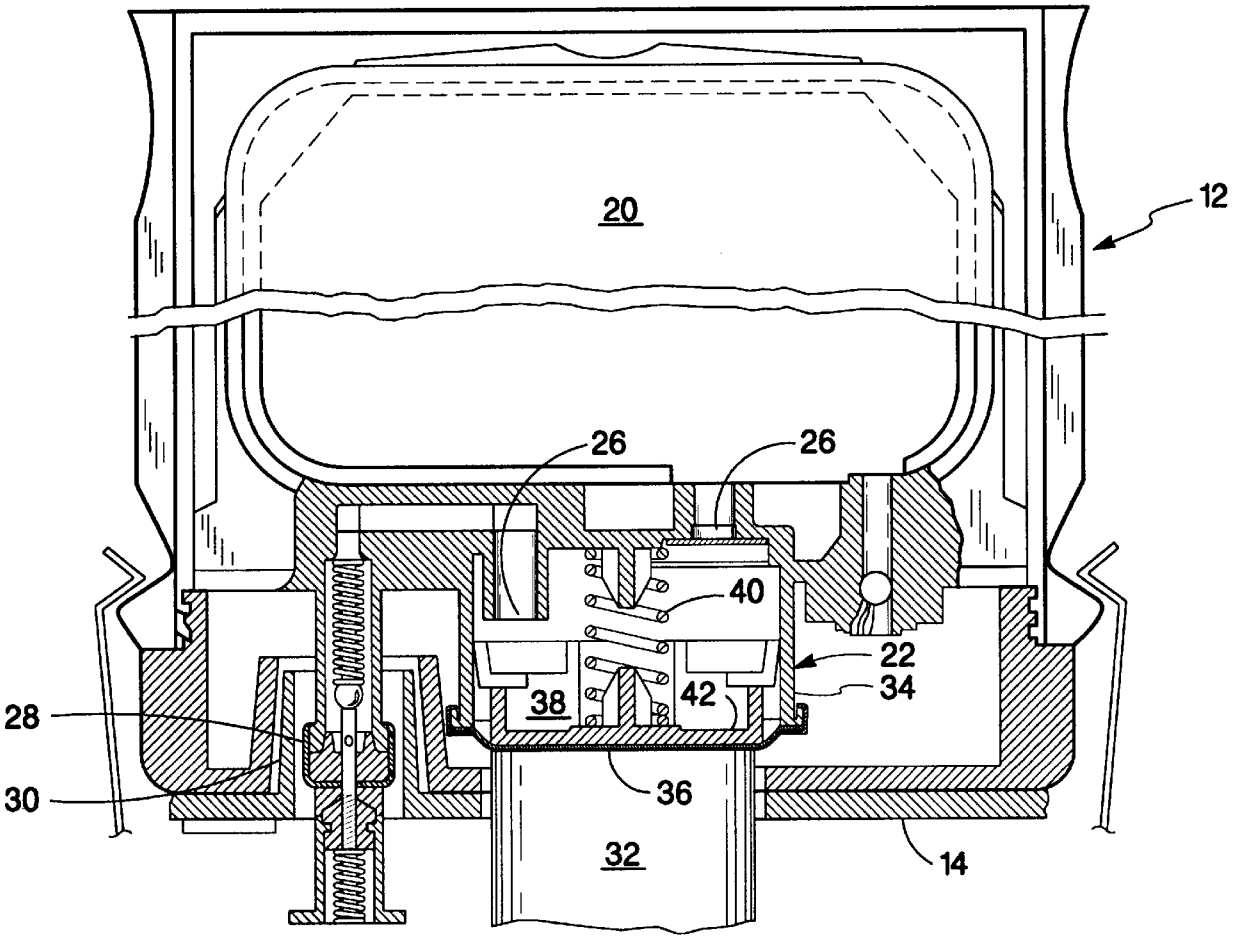
FIG. 2 depicts a cross section taken across lines 2–2' of the ink container of FIG. 1 shown with an actuator positioned for activating the diaphragm pump.

FIG. 2 depicts a sectional view of the ink container 12 mounted to the supply station 14 shown in FIG. 1. The ink container 12 includes the ink reservoir 20 that is in fluid communication with the diaphragm pump portion 22 by an inlet 24. Ink is selectively provided to the diaphragm pump portion 22 through the inlet 24. In one preferred embodiment the inlet 24 includes a check valve for allowing ink to pass from the ink reservoir 20 to the diaphragm pump portion 22 and for limiting ink passage from the diaphragm pump portion 22 to the ink reservoir 20. The diaphragm pump portion 22 expels ink through the outlet 26. Ink expelled from the diaphragm pump portion 22 is then provided to the printhead 16 via the supply station 14 and the conduit 18. In one preferred embodiment the outlet 26 acts as a check valve that allows ink to pass from the diaphragm pump portion 22 to the printhead 16 and limits ink passage into the pump portion 22 from either the printhead 16, supply station 14 or conduit 18. The check valve function is accomplished by a check valve disposed at the printhead 16, the flow resistance within the conduit 18, or both can be used to act as a valve limiting ink from returning to the diaphragm pump portion 22 through outlet 26.

With the ink container 12 properly positioned in the supply station 14 the fluid inlet 30 associated with the supply station engages the fluid outlet 28 associated with the ink container 12 to form a fluid interconnection between the ink container 12 and the supply station 14.

The diaphragm pump portion 22 in the preferred embodiment includes a chassis 34 and a diaphragm 36 which define a variable volume chamber 38. Within the chamber 38 is a biasing means 40 for biasing the diaphragm 36 towards the actuator 32. In the preferred embodiment, the biasing means 40 is a spring which biases a pressure plate 42 against the diaphragm 36.

The actuator 32 engages the diaphragm 36 and displaces the diaphragm 36 toward the chamber 38 compressing the spring 40. As the diaphragm 36 is displaced toward the chamber 38 the volume of the chamber 38 is reduced. This reduction in volume of chamber 38 pressurizes the ink within the chamber 38 causing ink to pass through outlet 26 towards the printhead 16. As the actuator 32 is removed the spring 40 relaxes, displacing the diaphragm 36 away from the chamber 38, increasing the chamber 38 volume, and reducing the chamber pressure, allowing ink to flow from the ink reservoir 20 into the chamber 38 through the inlet 24. In the preferred embodiment the inlet 24 is a check valve allowing ink to flow only from the ink reservoir 20 to the chamber 38 and limits ink flow from the chamber 38 to the ink reservoir 20. Therefore, as the diaphragm 36 is displaced toward the chamber 38 the inlet 24 prevents ink passage from the chamber 38 to the ink reservoir 20.

Figure 3:
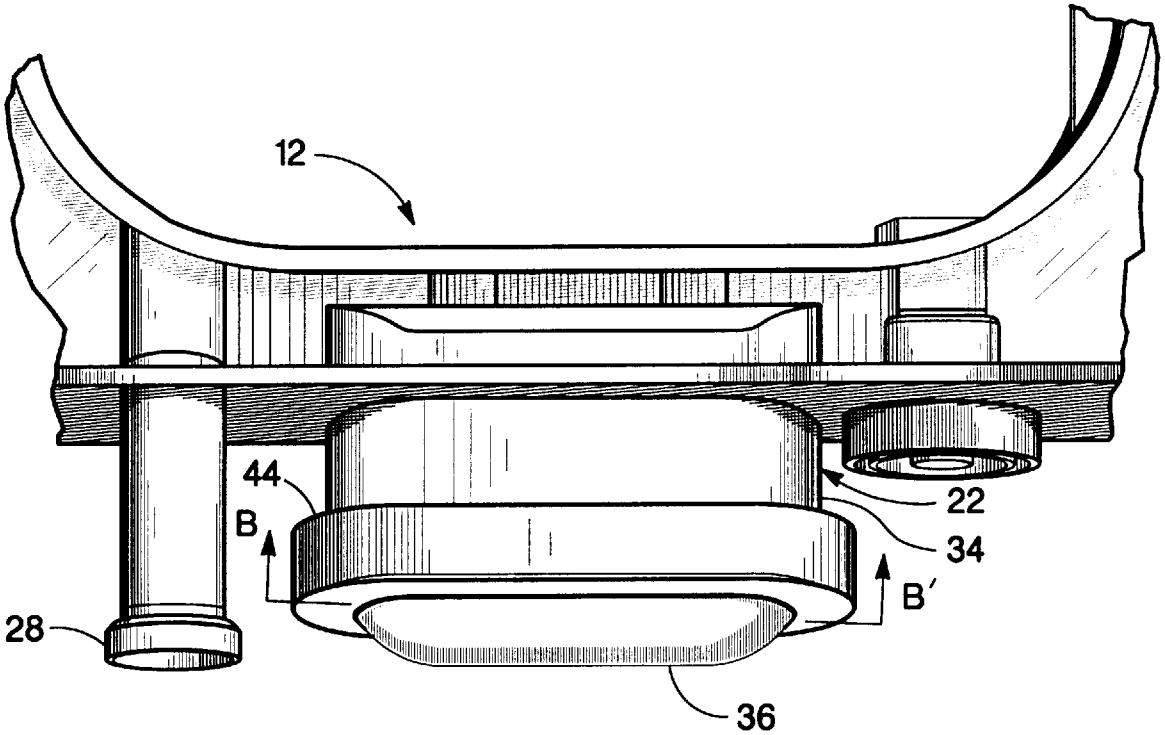
FIG. 3 represents a perspective view of the diaphragm pump of FIG. 2.

FIG. 3 is a perspective view of the diaphragm pump portion 22 of the present invention. The diaphragm pump portion 22 is formed integrally with the ink container 12. The diaphragm pump portion 22 includes the chassis 34 and the diaphragm 36. In the preferred embodiment the diaphragm is attached to the chassis 22 by means of a mechanical fastener such as a crimp cap 44. The crimp cap 44 mechanically holds the diaphragm 36 in compression with the chassis 34 to form a seal between the diaphragm 36 and the chassis 22. Although the preferred embodiment makes use of a crimp cap any other mechanical fastening device for maintaining the diaphragm in compression with the chassis 34 may also be suitable.

Figure 4:
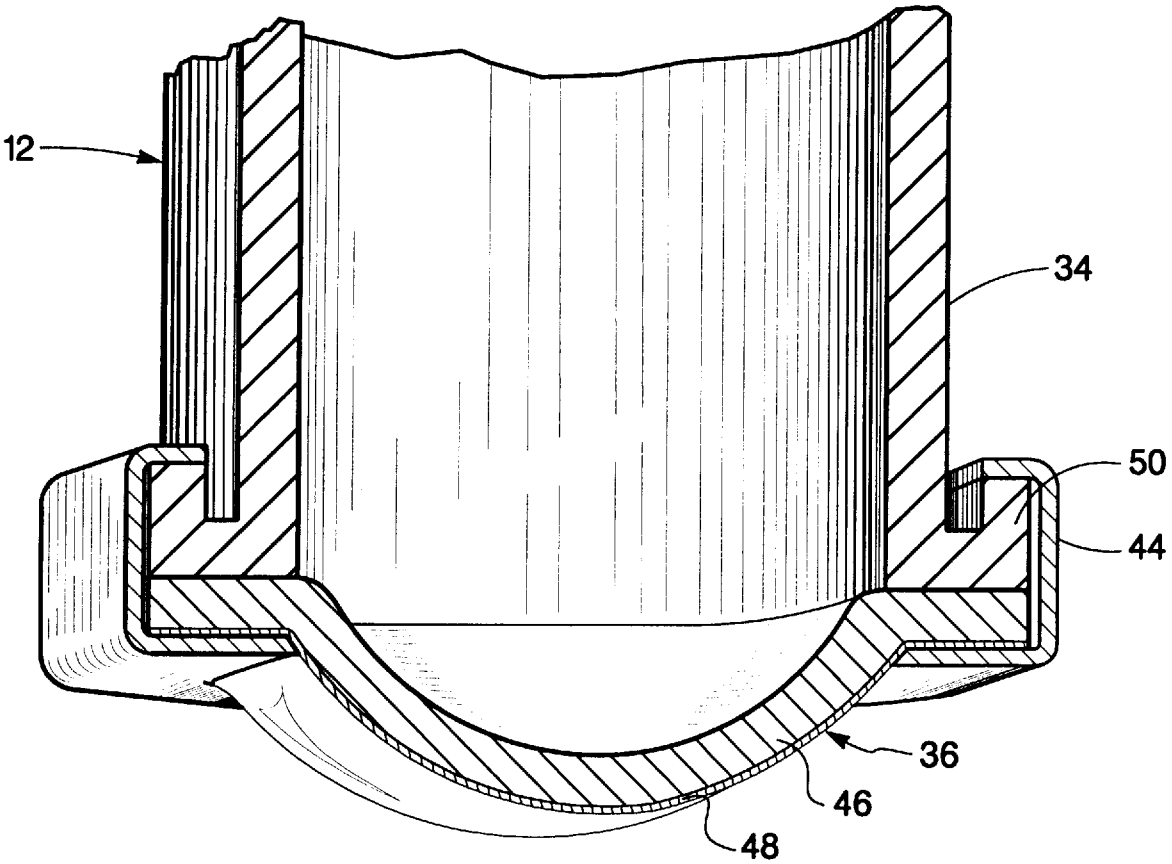
FIG. 4 depicts a sectional view taken across lines B–B' shown in FIG. 3.

FIG. 4 depicts the diaphragm pump portion 22 in section taken across lines B–B'. The diaphragm pump 22 includes the chassis 34, the diaphragm 36 and the crimp cap 44 for attaching the diaphragm 36 to the chassis 34. In the preferred embodiment the diaphragm 36 is made from an inner layer 46 formed from a compressible material which can be held in compression by a crimp cap to form a good fluid seal. This compressible material should be capable of withstanding large pressure loads without leaking or failing. The inner layer 46 must be able to withstand large pressure spikes which can occur when the ink container 12 is dropped. In addition the inner layer 46 should have a high fatigue life capable of operating over a large number of pumping cycles. Finally, the inner layer 46 should be of a material selected to provide a fluid barrier to fluids within the diaphragm pump portion 22. For example, aqueous inks contain water. Therefore, the inner layer 46 should provide a good barrier to water for ink containers 12 for use with aqueous inks. In this preferred embodiment the diaphragm further includes an outer layer 48 that is a vapor barrier layer.

The outer layer 48 that is in contact with air prevents air from permeating through the vapor barrier leaving air bubbles inside the chamber 38. Bubbles introduced into the chamber 38 can result in bubbles passing to the printhead 16 which can reduce printhead 16 reliability and reduce print quality. In addition, the outer layer 48 also provides a barrier to the loss of water vapor from the chamber 38. Therefore, the outer layer 48 should be formed of a material having a low permeability. In addition the outer layer 48 should have a high fatigue life capable of operating over a large number of pumping cycles without substantial increase in permeability and should be well suited to mechanical fastening.

In one preferred embodiment the inner layer 46 is formed from a molded elastomer diaphragm formed from Ethylene-Propylene-Diene Monomer (EPDM) or polyisoprene. The EDPM material is discussed in more detail in "Science and Technology of Rubber", editors James E. Mark, Burak Ehrman, and F. R. Eirich, Academic Press, London, 1994, p. 34. This inner layer 46 is thermally formed in a convex shape having a thickened central portion. In this preferred embodiment the outer layer 48 is formed from a high barrier polymeric film such as polyvinylidene chloride (PVDC )or SARAN ™ marketed by Dow Chemical of Midland, Mich. One such PVDC material is SARANEX II ™ marketed by Dow Chemical. The SARANEX material is a sandwich having 5 layers which include a SARAN center layer sandwiched between a pair of Ethyl Vinyl Acetate (EVA) layers. Positioned on each of the EVA layers is a low density Polyetheylne outer layers. The SARAN material is a very low permeability material. This material has permeability less than 1 cubic centimeter at 1 atmosphere per 100 square inches per day at 100 percent relative humidity at 23 degrees centigrade. The inner layer 46 and the outer layer 48 can be adhesively bonded together or coextruded and pressed to thermally bond or the outer layer 48 can be a vapor deposited metal that is deposited on the inner layer 46.

There is a tradeoff between the permeability of the inner layer 46 and the stiffness or force required to deform the diaphragm 38. For example, doubling the thickness of the elastomer material used in the inner layer 46 reduces the permeability of this material by one half. However, the increase in thickness of the elastomer material increases the stiffness of the material or force required to actuate the material. Therefore, the thickness of the inner layer 46 material should be selected to minimize the permeability while providing an activation force that is within the range of activation forces of the actuator 32.

In the preferred embodiment the chassis 34 has a flange 50 allowing the crimp cap 44 to be deformed around the flange 50 to hold the diaphragm 36 in compression against the chassis 34 to form a highly reliable seal. This preferred embodiment makes use of an elastomer inner layer 46 which is compressed by the crimp cap 44 to maintain a good compression seal between the diaphragm 36 and the chassis 34.

Figure 5:
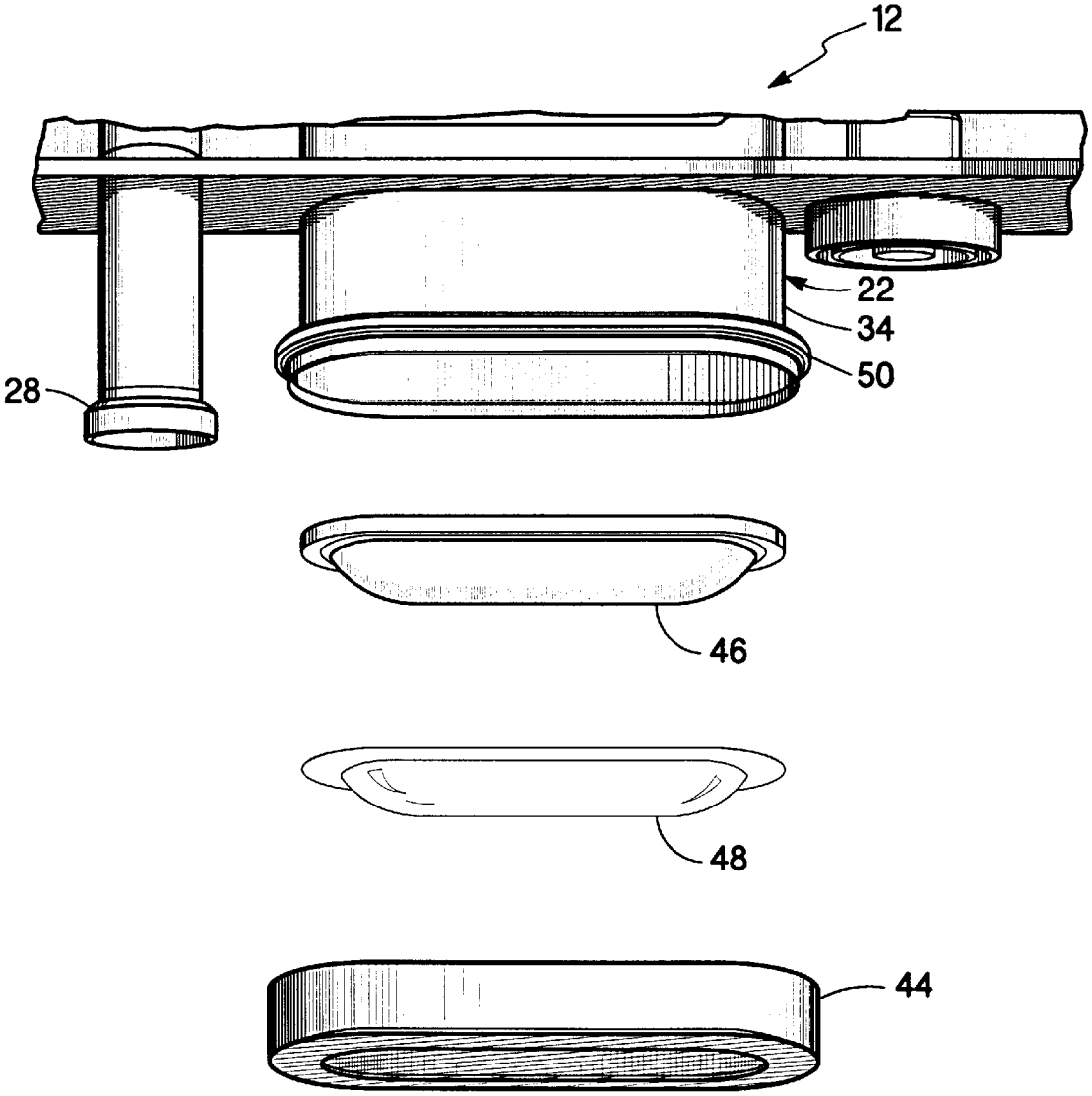
FIG. 5 depicts an exploded view of the diaphragm pump shown in FIG. 3.

FIG. 5 depicts an assembly drawing of the preferred embodiment of the diaphragm pump portion 22 shown in FIG. 3. The diaphragm 36 includes an inner elastomer layer 46 and outer film layer 48. The crimp cap 44 is positioned on the chassis 34 with the inner layer 46 and the outer layer 48 in compression there between. The crimp cap 44 is crimped or folded over the flange 50 to secure a compression seal between the chassis and inner and outer layers 46 and 48.

Figure 6A:
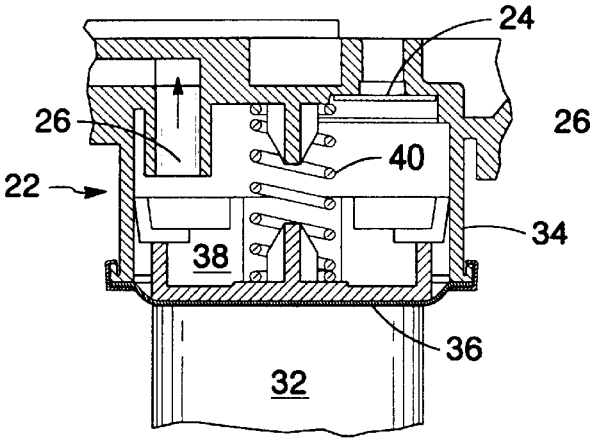
FIGS. 6*a*, 6*b*, 6*c*, 6*d*, and 6*e* depicts a sequence of cross-section views as shown in FIG. 2 illustrating operation of the diaphragm pump of the present invention.
Figure 6D:
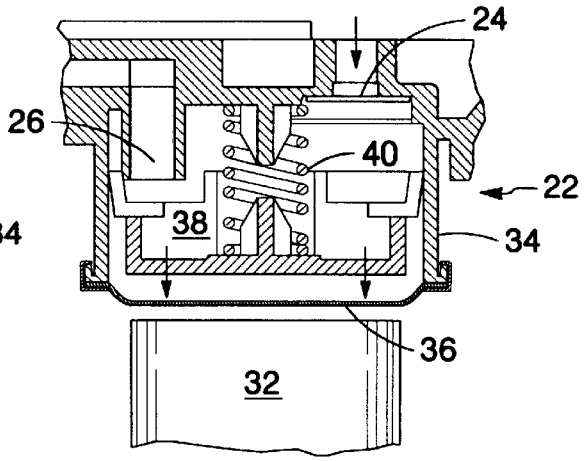
Figure 6B:
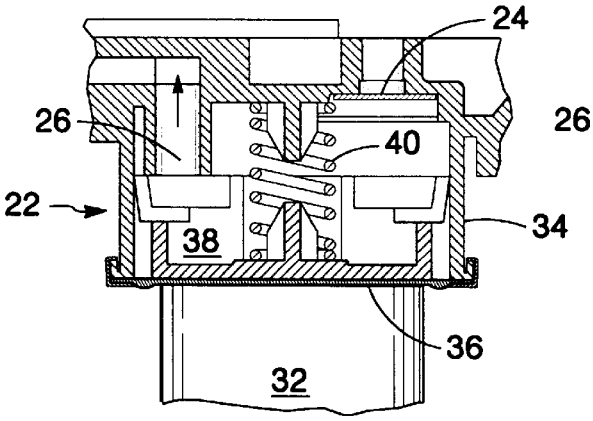
Figure 6E:
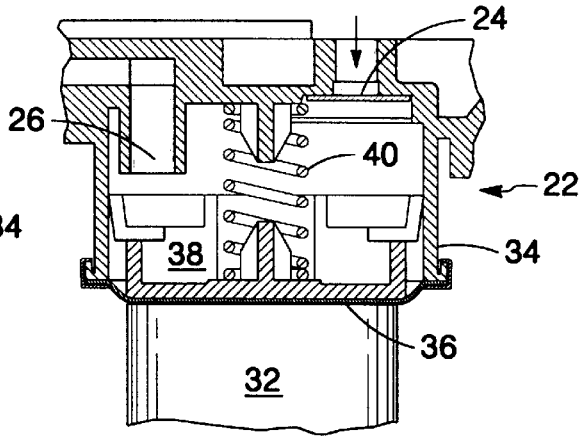
Figure 6C:
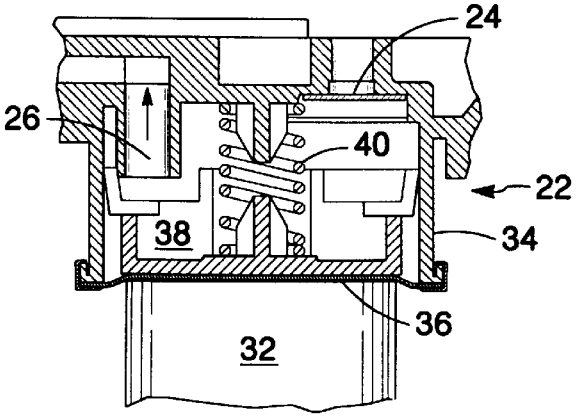

FIGS. 6*a*–6*e* show the operation of the diaphragm pump of the present invention. FIG. 6*a* depicts the beginning of the pump cycle the inlet valve 24 is closed preventing fluid flow from the ink reservoir 20 into the chamber 38 and the actuator 32 in engagement with the diaphragm 36. As the actuator 32 applies pressure to the diaphragm 36 to compress the biasing means 40 as shown in FIG. 6*b* and 6*c*. The displacement of the diaphragm 36 forces ink out of the chamber 38 and through outlet valve 26.

FIGS. 6*d* and 6*e* depicts removal from the diaphragm 36 causing the biasing means 40 to expand pushing the diaphragm 36 toward the actuator 32. As the diaphragm moves outwards towards the actuator 32 the volume of the chamber 38 increases drawing fluid from the ink reservoir 20 through check valve 24 to replenish the chamber 38. As discussed previously a valve at outlet 26 prevents fluid from the printhead or conduit 18 from replenishing the chamber 38. Either a check valve is placed at outlet 26 or a check valve is placed in printhead 16 or simply the back pressure within conduit 18 prevents ink from being drawn into chamber 38 during the refill cycle.

The diaphragm pump of the present invention provides a pump that is capable of operating for a repeated pump cycles without fatigue failures. In addition, the pump of the present invention is more resistant to leaking and rupture of the diaphragm during drop testing. Finally, the diaphragm pump of the present invention is well suited to a high volume manufacturing environment allowing the diaphragm to be attached quickly to the pump chassis forming a highly reliable seal. In addition, the use of a crimp cap allows the diaphragm tension to be highly controlled thereby allowing a diaphragm pump having a more consistent chamber volume to be formed.

What is claimed is:

1. An ink supply of the type having a diaphragm pump for providing ink to a printhead, the diaphragm pump comprising:

a diaphragm barrier layer;

a chassis at least partially defining a variable volume chamber, the chassis having a flange disposed proximate an opening in the chassis; and a fastening device, the fastening device disposed on the chassis with the diaphragm barrier layer disposed between the fastening device and the chassis, the fastening device engaging the flange to compress the diaphragm barrier layer against the chassis forming a compression seal between the diaphragm barrier layer and the chassis.

2. The ink supply of claim 1 wherein the diaphragm barrier layer is a vapor barrier layer.

3. The ink supply of claim 1 wherein the diaphragm barrier layer is a metallic film layer.

4. The ink supply of claim 1 wherein the diaphragm barrier layer is a polymeric film layer.

5. The ink supply of claim 1 wherein the diaphragm barrier layer is formed from an elastomer layer.

6. The ink supply of claim 5 wherein the diaphragm barrier layer is formed from EPDM.

7. The ink supply of claim 1 wherein the diaphragm barrier layer includes a first and second layer with the first layer formed from an elastomer material and the second layer formed from a polymer material.

8. The ink supply of claim 1 wherein the fastening device is a crimp cap.

9. An ink supply of the type having a diaphragm pump for providing ink to a printhead, the diaphragm pump having a chassis and a diaphragm, the diaphragm comprising:

a vapor barrier layer for limiting transfer of air through the diaphragm into the diaphragm pump; and an elastomer layer disposed between the chassis and the vapor barrier layer, the elastomer layer limiting the transfer of fluid though the diaphragm.

10. The ink supply of claim 9 further including a crimp cap, the crimp cap disposed on the chassis with the elastomer layer and the vapor barrier layer disposed between the crimp cap and the chassis, the crimp cap engaging the chassis to compress the elastomer layer against the chassis to define, at least partially, the variable volume chamber.

11. The ink supply of claim 10 wherein the vapor barrier layer is formed from PVDC and the elastomer layer is formed from EDPM.

12. A method for forming an ink container diaphragm pump, the method comprising:

positioning a diaphragm and crimp cap on a chassis having a variable volume chamber, the chassis having a flange disposed proximate a chassis opening;

crimping the crimp cap to engage the flange to compress the diaphragm, holding the diaphragm securely to the chassis.

* * * * *